United States Patent [19]

Ménioux

[11] 4,419,057

[45] Dec. 6, 1983

[54] ROTARY PISTON MOTOR

[75] Inventor: Claude C. F. Ménioux, Nogent sur Marne, France

[73] Assignee: Societe Nationale d'Etude et de Construction de Moteurs d'Aviation, "S.N.E.C.M.A.", Paris, France

[21] Appl. No.: 231,107

[22] Filed: Feb. 3, 1981

[30] Foreign Application Priority Data

Feb. 6, 1980 [FR] France ..... 80 02539

[51] Int. Cl.[3] ..... F01C 1/077

[52] U.S. Cl. ..... 418/36

[58] Field of Search ..... 123/18 A, 245; 418/36

[56] References Cited

U.S. PATENT DOCUMENTS 2,349,848 5/1944 Davids ..... 418/36
3,807,368 4/1974 Johnson ..... 418/36 X

FOREIGN PATENT DOCUMENTS 38996 8/1931 France .
941674 8/1948 France ..... 418/36
953008 5/1949 France ..... 418/36
980793 5/1951 France .
314134 6/1929 United Kingdom ..... 418/36
947351 1/1964 United Kingdom .
1552432 9/1979 United Kingdom ..... 418/36

*Primary Examiner*—Michael Koczo
*Attorney, Agent, or Firm*—Oblon, Fisher, Spivak, McClelland & Maier

[57] ABSTRACT

An internal combustion rotary volumetric motor operating on a four stroke cycle including a fixed exterior housing which delimits an annular space, a plurality of pistons that rotate in the same direction mounted in the annular space, a rod having a shaft integral therewith diametrically connecting the pistons in pairs and propelling the pistons by cyclical speed variation which causes a volume variation in the space delimited by radial surfaces of the pistons, the spaces between the pistons forming chambers of the motor operating on a four stroke cycle, a rotary crown having a plurality of ports formed therein, wherein the annular space within which the pistons move is delimited by the housing and the rotary crown having the ports through which the rods are engaged and which provide an angle of clearance for the rods for advancing and receding of the pistons, the rotary crown forming part of an outlet motor shaft, and a transmission mechanism attaching the rotary crown to the shafts.

14 Claims, 8 Drawing Figures

ROTARY PISTON MOTOR

BACKGROUND OF THE INVENTION

1. Field of the Invention

The present invention is directed to an improvement in rotary volumetric motors.

2. Description of the Prior Art

There are two main categories of motors among heat engines which transform the thermal energy provided by fuel into mechanical energy. First, continuous flow motors of the gas turbine type can be used which operate according to the Joule cycle. Secondly, volumetric motors can be used wherein compression and expansion are obtained by volume variation and which operate according to the Beau de Rochas (gasoline engines) or Diesel cycle.

None of the motors which fall into these two categories is completely satisfactory insofar as the continuous flow motors have an advantage over the others in that they are lighter, which makes them preferable for use as aircraft engines, but their specific fuel consumption is high, on the order of 200 g per horsepower hour for large gas turbines, a figure which can increase to 300 or more for small gas turbines. Moreover, gas and Diesel volumetric motors are heavy and cumbersome, which is a serious disadvantage but is in general acceptable for terrestrial motors because of their low specific fuel consumption (Diesel motors may have specific fuel consumption levels on the order of 150 g per horsepower hour).

The differences in specific fuel consumption between continuous flow and volumetric motors expressed above are based on optimum operating conditions at a constant load for both types of machines. These differences are even greater when the motors are operating under a partial load, wherein the specific fuel consumption of continuous flow engines increase rapidly when the load is reduced while, on the contrary, the specific fuel consumption of Diesel engines varies only slightly and may even improve when the load is reduced.

Applicant's analysis of this matter has resulted in the following comments and led to the development of the present invention. One of the main reasons for the low fuel consumption of volumetric motors lies in the fact that compression and expansion occur volumetrically, so that compression and expansion yields are very near 1. As a first approximation, it is generally considered that compression and expansion are isotropic. On the other hand, compression and expansion in a continuous flow motor occur with a yield substantially lower than 1. Despite the progress achieved since the development of turbomachines, the compression yield is on the order of 88% and the expansion yield is on the order of 90%. In addition, these figures apply only to turbomachines of large size (and within a narrow operating range), while small turbomachines (or large ones operating outside this range) have yields that are even further from the yield of unity which has almost been achieved by Diesel motors.

One of the main objectives of this invention is to have compression and expansion occur volumetrically, so as to take advantage of the near-unity yields provided by this kind of compression or expansion. On the other hand, the low fuel consumption of volumetric motors is also due to the fact that the efficient temperature to be taken into consideration in the cycle is very near the practically continuously), the maximum temperature of the combustion chamber must be limited, given the actual state of metallurgical knowhow. Even if a stoichiometric temperature is reached locally in the combustion chamber, the most efficient temperature, that is the temperature that conditions the yield of the cycle, is much lower.

SUMMARY OF THE INVENTION

It is therefore an objective of the present invention to permanently provide an efficient cycle temperature which approaches the stoichiometric temperature.

The two advantages of the invention cited above already exist in other motors, in particular in Diesel motors. But, these have the disadvantages of being heavy and bulky, as explained in the remarks that follow.

A conventional Diesel motor includes a connecting rod assembly which transmits force either from the expanding gases to the crankshaft (the motor pressure during expansion), or the crankshaft force on the gases (the compression force during this phase). Taking the same cylinder, this force occurs at different times and it is necessary to calculate the resistance of the parts (connecting rods, crankshaft wrist pins, etc.) for maximum force without the possiblity of any compensation, and thus to proportion them for this maximum force, for each cylinder, connecting rod, crankpin, and crankshaft assembly separately, without any possibility of compensation for making the unit lighter, although there is a motor torque (at the outlet point of the crankshaft) compensation since compression provides resistant torque. In particular, each connecting rod must be proportioned for maximum force (at the beginning of the combustion cycle).

It is an objective of this invention to mitigate these disadvantages while retaining the cycle of the Diesel motor, and thus its specific fuel consumption advantages, by using a configuration which allows the forces of compression and expansion to be mutually compensated internally.

Also, one of the limitations of available power for volumetric motors is caused by the air inflow problem (whether through carburetion or other system), because of the relatively small size of the valves and intake ports. The valves, for example, are normally housed in the cylinder head, (it should also be noted that a cam shaft, rocker arm shafts and rocker arms also increase complexity, bulk and mass). But because of the fact that the cylinder head must also include the ignition system and/or fuel injection system, the surface available for the valves is, in general, a limiting factor in engine revolution speed. The strangulation effect produced by the valves is, in fact, one of the reasons for the power loss which occurs in these motors at high RPM. Thus, conventional volumetric motors have a high ratio of mass per unit of power, because of the inflow problem which is due to the fact that the size of the intake valves cannot be increased.

It is a further objective of this invention to provide a solution to this air inflow problem by using a much larger intake system than is conventionally used. In addition, the applicant has in the past performed tests which proved that, for motors with alternating pistons, the friction of the pistons against the walls was greater at top dead center and bottom dead center than at the midpoint of the stroke. The problem is not that the piston reaches top or bottom dead center, but rather that, at those points, it is immobile in relation to the housing. Each time piston motion ceases, the oil film which reduces this friction (which causes loss but especially wear) is broken, and, despite all the progress achieved, this limits the life expectancy of conventional volumetric motors.

It is accordingly an objective of this invention to cause a volumetric motor to operate without any momentary cessation of piston motion relative to the exterior housing.

Finally, it must be noted that the specific fuel consumption advantages of Diesel motors over continuous flow motors in terms of fuel consumption are entirely present only in four cycle Diesel engines.

Therefore, in comparing Diesel motors and the motors according to this invention, this is the case which must be considered. For example, in a four cylinder Diesel, there are two engine cycles per revolution, or in other words, each cylinder completes one engine cycle in two revolutions. It is an objective of this invention to provide four engine cycles per revolution, while reducing bulk, mass, the number of parts, and the corresponding cost.

There exist rotary volumetric motors which include fixed housing delimiting an annular chamber in which are mounted unidirectionally rotating pistons which are diametrically connected in pairs by a connecting rod and driven by a cyclical speed variation causing volume variations in the space delimited by the radial surfaces of the pistons, such spaces between the pistons forming the chambers of a motor operating on a four stroke cycle.

However, conventional motors of this type are not entirely satisfactory for the following reasons. In all cases, the power recovery mechanism, which employs cams or connecting rods, is heavy and bulky, because the internal force thereof is compensated only partially or not at all. Additionally, in all cases, the intake and exhaust or air is strangled under conditions similar to those in alternating piston engines. Finally, some of these motors include rotating housings and two working chambers instead of four, etc.

According to the present invention, the annular space in which the pistons move is delimited by the housing and a rotary crown having ports through which the rods are engaged and which provides the angle of clearance for the pistons to advance and recede, such crown forming part of the motor outlet shaft and being connected by a transmission mechanism to the shafts which are an integral part of the piston rods. In this manner, the motor according to the invention is lightweight, as opposed to conventional rotary volumetric motors, is less bulky, and operates in a reliable fashion and cannot seize up.

It should be noted that the engine shaft may be positioned on either side of the rotary volumetric motor. However, an irregularity in the torque applied to the pinion gears during operation of the device described hereinabove has been discerned.

FIG. 4 is a diagram showing the angle of revolution of the pinion gears on the abscissa, and the engine torque applied to the pinion gears on the ordinate. Curve 31 shows the evolution of engine torque during the cycle: it increases, reaches a maximum, decreases, reaches zero, becomes inverted (becomes resistant during compression), returns to zero, and this occurs two times per revolution. stoichiometric temperature. This is an acceptable temperature for the adjacent parts (cylinder, cylinder head and pistons) due to the fact that this temperature is a maximum temperature which is reached during a very small fraction of the duration of the complete cycle, so that neither the fixed nor moving parts have time to overheat during this fraction of time and, even in the absence of a coolant, ten to maintain a much lower temperature.

For continuous flow motors, on the contrary, and because the fixed parts and especially the moving parts are permanently subjected to the temperature of the flow in which they are immersed (rather than being subject to varying temperatures with a very high peak of short duration and a varying but always much lower temperature When the torque is inverted, a gear clatter occurs, which may cause deterioration of the gears. To mitigate this disadvantage, a motor is employed wherein two motors are symmetrically positioned on the same axis at a 90° angle, using the angle of rotation of the pinion gears as the angle of reference. As previously described, each module includes two connecting rod-crank mechanisms connecting each pair of pistons to each pinion gear, but in assembling the two modules, the two pinion gears are common and the two connecting rod-crank mechanisms of each module which activate the same pinion gear are at 90° angles (using the angle of rotation of the pinion gears as the reference angle).

The torque of the assembled unit is of the same regularity as that of a sixteen cylinder four cycle engine having eight engine cycles per revolution.

FIG. 5 is a diagram having the same coordinates as FIG. 4, wherein two curves (31 and 32) at 90° angles are shown, and which illustrate the evolution of engine torques applied to the pinion gears of a pair of assembled motors.

It can be seen that, when the sum of the motor torque or resistance (as the case may be) shown on curves 31 and 32 is totalled, the value of the resulting average torque (33) is nearly constant.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
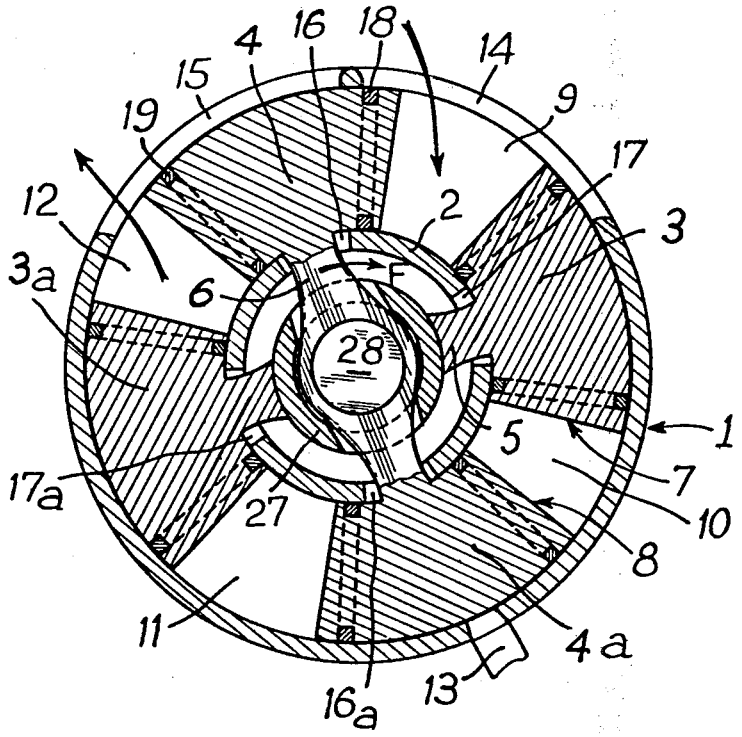
FIG. 1 is a cross-sectional view of a preferred embodiment of the rotary motor according to the invention.
Figure 2:
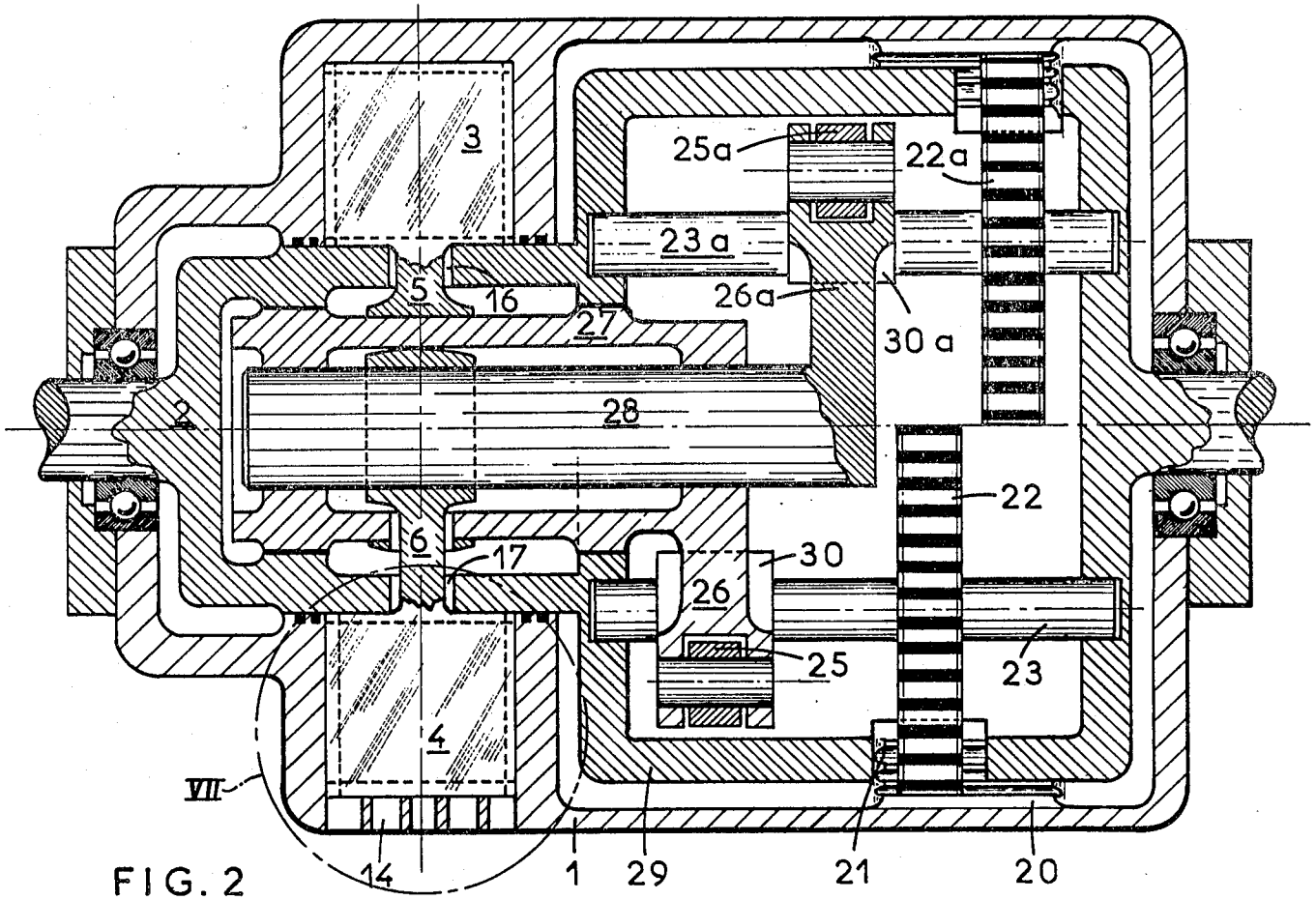
FIG. 2 is a simplified longitudinal section view of the rotary motor according to the invention, wherein each sub-assembly has been drawn on the same plane.

FIGS. 1 and 2 show a rotary volumetric motor according to the invention including a fixed exterior housing (1) delimiting an annular space, both peripherally and on its front and rear surfaces. The housing is shown as a single unit on the drawings for purposes of simplicity, but, of course, it includes the number of parts required for assembly.

A rotary crown (2) is positioned inside the housing (1), and internally delimits the annular space in which the four pistons (3, 3*a* and 4, 4*a*) rotate in the direction of the arrow (F). Pistons 3 and 3*a* are symmetrical, connected by a connecting rod (5), while pistons 4 and 4*a* are also symmetrical and connected in a similar fashion by a connecting rod (6). Connecting rods 5 and 6 are attached to shafts 27 and 28 respectively, by a clevis pin (not shown) or any other conventional mechanism.

Figure 7A:
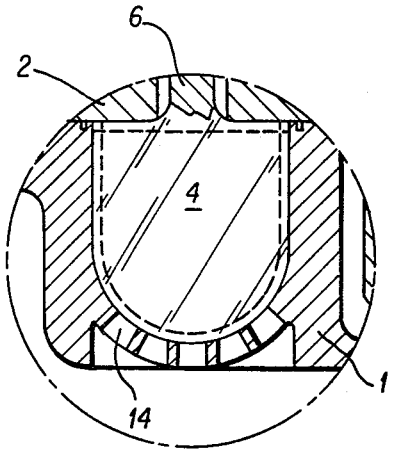
Figure 7B:
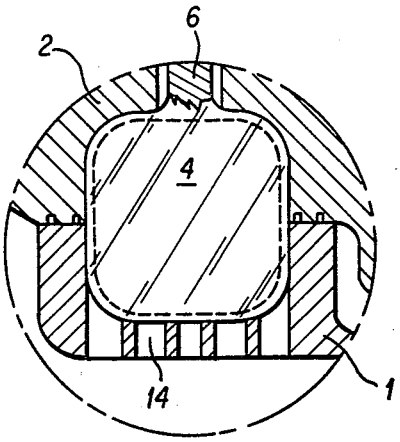

The annular space in which the pistons move may have a quadrangular cross-section as shown in FIG. 2, or a circular section, as for instance in the simplest cases, or any combination or circular sections and linear segments as shown in FIGS. 7*a* and 7*b*.

The radial surfaces (7, 8) of the adjacent pistons delimit the variable volume spaces (9, 10, 11, 12) between them, which correspond to the chambers of a motor which operates on a four stroke cycle.

The assembly formed by the crown (2) and pistons (3, 3*a* and 4, 4*a*) rotates in the generaly direction indicated by the arrow (F), while the pistons (3, 3*a* and 4, 4*a*), as will be explained below, are also propelled by a cyclical speed variation corresponding to an acceleration and deceleration of each connecting rod (5, 6), and the pistons (3, 3*a* and 4, 4*a*) are caused to alternatively advance and recede, providing a cyclical volume variation in the chambers (9, 10, 11, 12), allowing the four-stroke cycle to be completed. In the position shown in FIG. 1, chamber 9 is in the intake phase, chamber 10 is in the compression phase, chamber 11 is in the expansion phase and chamber 12 is in the exhaust phase. In this manner, the force needed for the compression exerted on one surface of a piston is provided by the force of the expanding gases, which is exerted on the other surface of the piston, and therefore passes directly from one to the other, which therefore avoids increasing the mass and/or bulk which would be needed if the latter force had to be carried by the connecting rod and corresponding crankpin then by torsion of the crankshaft, by a second crankpin, etc., then by another connecting rod to the piston in the compression phase, as occurs with alternating piston volumetric motors.

The combustible mixture is ignited when one of the chambers (10) becomes positioned opposite the spark plug (13), which is mounted on the housing (1). It should at this point be noted that, should the motor be operated on a Diesel cycle, the spark plug (13) is replaced by a fuel injector.

The housing (1) also has a port (14) serving as the intake of the combustible gas mixture in the case of an ignition motor or for fresh air in a Diesel cycle. Port 15 serves as the exhaust for burnt gases. In order to provide the angle of clearance for rods 5 and 6 for the pistons to advance and recede, the rotary crown (2) includes ports (16, 16*a* and 17, 17*a*).

To provide a seal between the fixed exterior housing (1) and the internal rotary crown (2) and lateral surfaces if they are present, on the one hand, and the pistons (3, 3*a* and 4, 4*a*) on the other hand, these are fitted with sealing joints (18, 19). FIG. 1 shows a single sealing joint at each end of the piston, but, of course, there may be several in a row. If the housing has a circular section, the sealing joint between the fixed housing (1) and the rotary crown (2) is located at the average diameter of the torus. In the case of a rectangular section, the exterior housing may constitute three surfaces and sealing sections are placed in the area where the interior rotary crown (2) is connected.

The angle of clearance and the expanded length of the pistons are determined by the volumetric compression rate selected. From this, one can determine the dimensions of ports 16, 16*a* and 17, 17*a* in crown 2 to provide the piston clearance needed. The intake and exhaust ports may advantageously have an expanded length corresponding to the maximum distance between the pistons and the maximum width compatible with the fixed housing.

Figure 3:
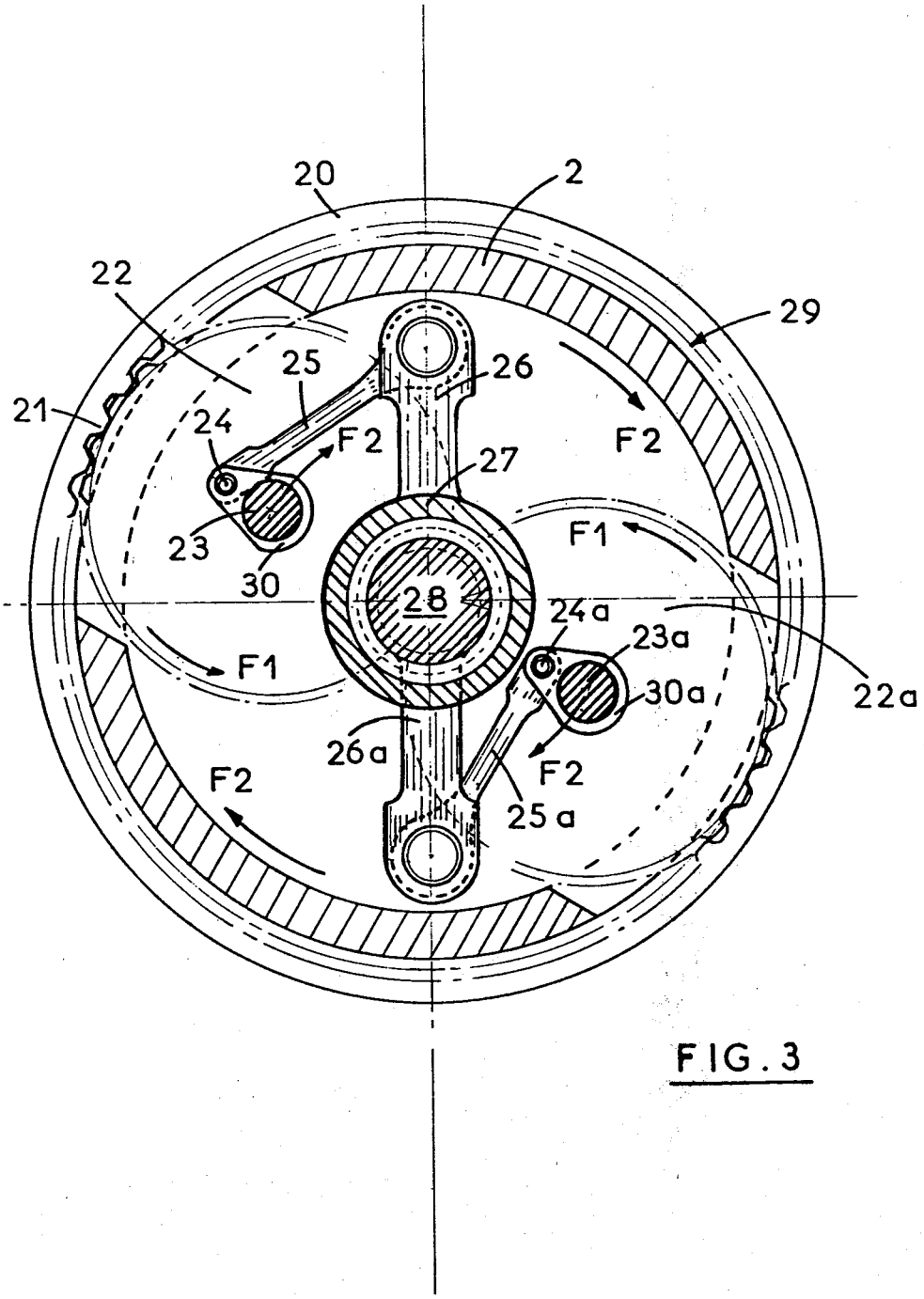
FIG. 3 is a diagrammatic view of the cross-wise positioning of the mechanisms connecting the piston-connecting rods and power transmission mechanism.
Figure 4:
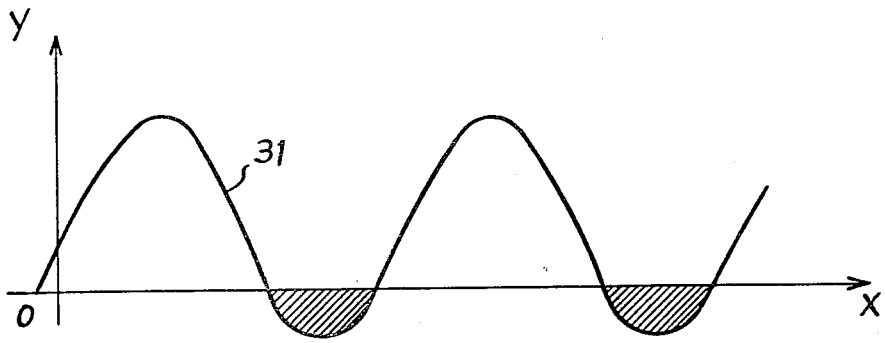
FIG. 4 is a diagram representing the torque of a single-module motor as a function of the angle of rotation of the pinion gears.
Figure 5:
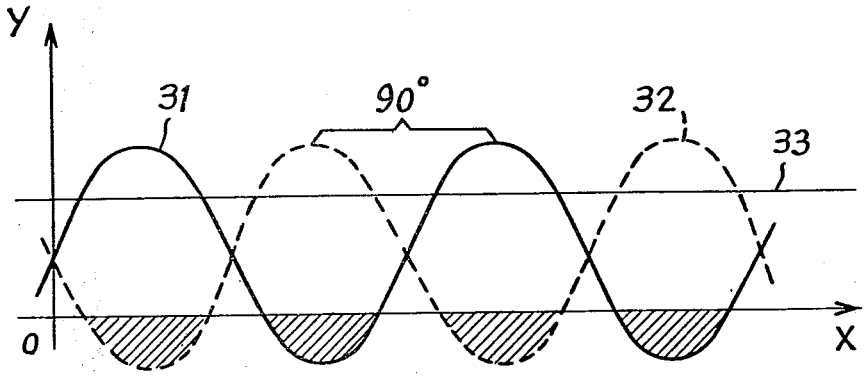
FIG. 5 is a diagram representing the torque of the two modules of the motor as a function of the angle of rotation of the pinion gear.

The mechanical power produced at the piston level is recovered on a shaft connected to crown 2 by a "squirrel cage" (29), using a transmission device which includes a fixed exterior crown (20) (see FIGS. 2 and 3) having interior gear teeth 21 into which two pinion gears (22, 22*a*) enmesh, and having half the number of teeth of crown gear 20. These pinion gears (22, 22*a*) are located on different planes and do not mesh with each other. The squirrel cage (29) which is integrally attached to crown 2 has diametrically opposed axles 23, 23*a*, on which are mounted rotary pinion gears, 22, 22*a*, and to which is connected by a crankpin (30, 30*a*) an eccentric axle (24, 24*a*) to which one of the ends of a connecting rod (25, 25*a*) is jointed, with the other end jointed on another crankpin (26, 26*a*). Crankpins 26 and 26*a* are integral parts of shafts 27 and 28, respectively, which have connecting rods 5, 6 connected to them and are propelled by pistons 3, 3*a* and 4, 4*a*.

During each active gas combustion phase, when the pistons recede, each pinion gear (22, 22*a*) is driven by the corresponding connecting rod (25, 25*a*) in the direction indicated by arrow F1. As the pinion gear axles are integral parts of crown 2, and because pinion gears 22 and 22*a* mesh with the fixed exterior crown (20), crown 2 rotates in the direction of arrow F2 (thus in the opposite direction of rotation of pinion gears 22, 22*a*), and of the outlet shaft to which the motor force is applied.

Correlatively, the three-rod type articulated mechanism formed by crankpins 30, 30*a*, connecting rods 25, 25*a* and crankpins 26, 26*a* is proportioned so that a complete revolution of crankpins 30, 30*a* around their axles (23, 23*a*) causes an alternating oscillation of crankpins 26, 26*a*, and thus of the pistons, within a range of two extremes determined by the volumetric compression ratio selected.

Because pinion gears 22 and 22*a* have half the number of teeth of crown gear 20, this alternating oscillation is produced twice per revolution of the rotary crown (2) (and thus of the outlet shaft), causing the pistons to advance and recede twice per revolution.

Figure 6:
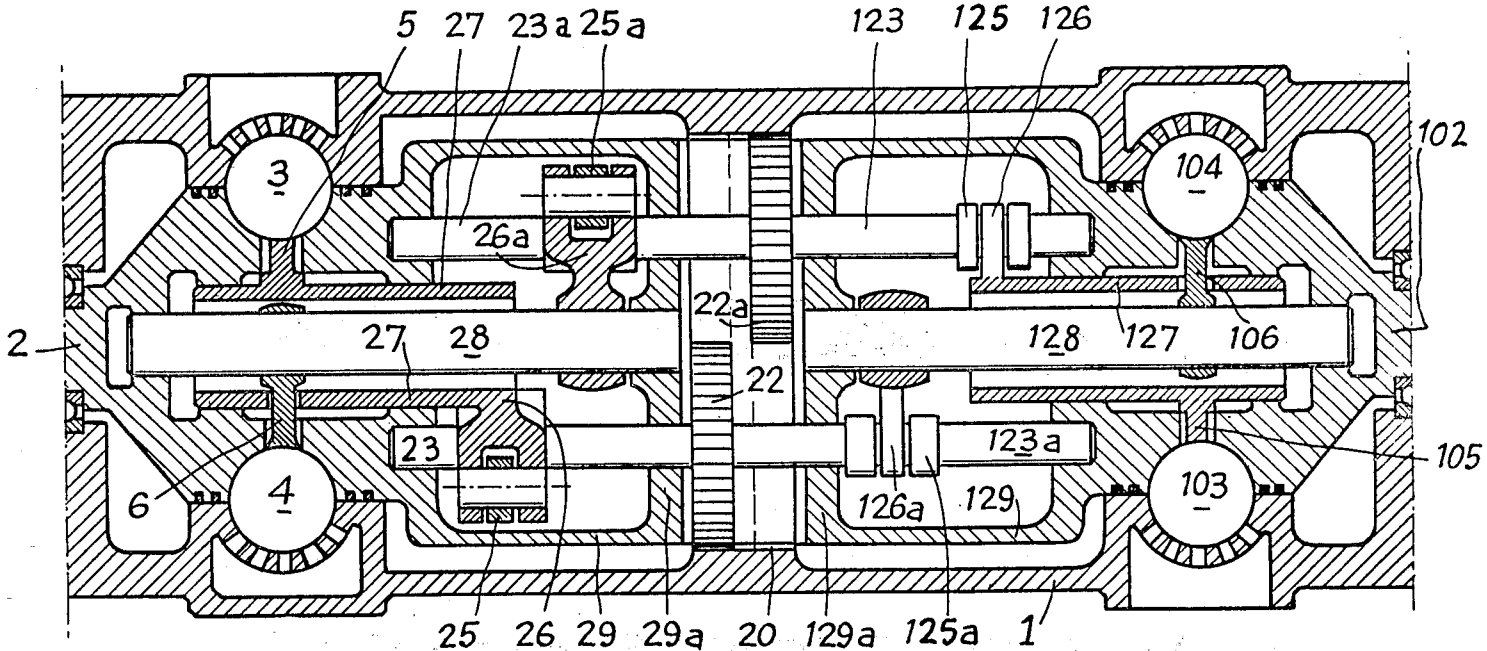
FIG. 6 is a longitudinal sectional view of the motor including two modules, and FIGS. *7a* and *7b*, show different embodiments of the portion VII of FIG. 2.

FIG. 6 is a longitudinal sectional view of the motor formed by two modules placed in the same housing (1), along the same axis, but at a 90° angle, with the angle of rotation of the pinion gears used as the angle of reference.

Each of the two modules is identical to the module described above; the module shown at left having the same reference numbers, while the other module, at right, has the same reference number in 100 series.

Each module constitutes two pairs of pistons (only one piston of which is shown) (3, 4 and 103, 104), which are radially connected in pairs by means of two rods (5, 6 and 105, 106) which move in an annular space delimited by the housing (1) and a rotary crown (29, 129), forming the outlet shaft (2, 102). Rotary crowns 29 and 129 are connected to each other to form a single assembly and are connected by a transmission mechanism to shafts 27, 28 and 127, 128, which are integrally attached to piston rods 5, 6 and 105, 106.

The transmission mechanism includes two pinion gears (22, 22*a*) that are common to both modules and mesh with the gears of a crown (20) provided in the housing (1), with each pinion gear (22, 22*a*) respectively wedged on a shaft (23, 123*a* and 23*a*, 123) which is common to both modules. Pinion gears 22 and 22*a*, which are common to both modules, are included between two radial walls (29*a* and 129*a*), one of which belongs to the module on the left and the other to the module on the right, and a part of common assembly 29-129.

Shaft 23, 123*a* is connected by connecting rod 25 to crankpin 26 of exterior shaft 27 and by connecting rod 125*a* to crankpin 126*a* of exterior shaft 128. In addition, shaft 23*a*, 123 is connected by connecting rod 25*a* to crankpin 26*a* of exterior shaft 28, and by connecting rod 125 to crankpin 126 of exterior shaft 127.

Crankpin 26*a*, connected to shaft 23*a* and crankpin 126 connected to 123 which drive pinion gear 22*a* are at 90° angles. Similarly, crankpin 26, connected to shaft 23 and crankpin 126*a*, connected to shaft 123*a*, which drive pinion gear 22 are at 90° angles.

The device which has just been described may, of course, be modified in various ways within the scope of the invention, in particular by replacing the fixed exterior crown (20), onto which the two pinion gears (22, 22*a*) are meshed, with a fixed wheel with gear teeth on the housing, wherein two planetary pinion gears would mesh, the gears having half the number of teeth of the fixed gear wheel and being set at two points which would be diametrically opposed to the rotary crown (2). The average position of the crankpins (26, 26*a*) may also be placed at 90° angles, for instance, rather than being diametrically opposed, as shown in the attached drawings.

What is claimed as new and desired to be secured by Letters Patent of the United States is:

1. An internal combustion rotary volumetric motor operating on a four stroke cycle, comprising:

a fixed exterior housing which delimits an annular space;

a plurality of pistons that rotate in the same direction mounted in said annular space;

a rod having a shaft integral therewith diametrically connecting said pistons in pairs and propelling said pistons by a cyclical speed variation which causes a volume variation in the space delimited by radial surfaces of the pistons, said spaces between the pistons forming chambers of said motor operating on a four stroke cycle;

a rotary crown having a plurality of ports formed therein wherein the annular space within which the pistons move is delimited by the housing and said rotary crown having said ports through which the rods are engaged and which provide an angle of clearance for the rods for advancing and receding of the pistons, said rotary crown forming part of an outlet motor shaft; and a transmission mechanism attaching said rotary crown to the shafts.

2. A motor according to claim 1, further comprising:

a squirrel cage attached to the rotary crown;

a stationary exterior crown having interior gear teeth which is fixed to the exterior housing;

two rotating pinion gears;

two diametrically opposed axles mounted on said two rotating pinion gears which are staggered longitudinally and which mesh with said interior gear teeth of said fixed exterior crown, and wherein each of said pinion gears has half the number of teeth of said fixed exterior crown, and each of said pinion gears further comprises an axle which is eccentric in relation to its rotation axis, a connecting rod, one end of which is jointed to said axle, and a crankpin connected to an opposite end of said connecting rod and which comprises an integral part of one of the shafts.

3. A motor according to claim 1, further comprising means forming an airtight seal between the housing and the rotary crown.

4. A motor according to claim 1, wherein a diametrical section of the annular space delimited by the housing and the rotary crown is rectangularly shaped.

5. A motor according to claim 1, wherein a diametrical section of the annular space delimited by the housing and the rotary crown is circularly shaped.

6. A motor according to claim 1, wherein a diametrical section of the annular space delimited by the housing and the rotary crown is shaped in the form of a combination of circular arcs and line segments.

7. A motor according to claims 3 or 5, wherein a joint plane between the exterior housing and the rotary crown is located at the average diameter of the torus of said annular space.

8. A motor according to claim 1, the housing having intake and exhaust ports formed therein for flow of gases.

9. A motor according to claim 8, the ports for intake and exhaust of gases having an expanded length which corresponds to the maximum distance between the pistons and a maximum width which is compatible with the fixed housing.

10. A motor according to claim 1, further comprising a fuel injector, the housing having a hole formed therein for mounting said fuel injector for the motor operating on a diesel cycle.

11. A motor according to claim 1, further comprising a spark plug, the housing having a hole formed therein for mounting said spark plug for the motor operating on an ignition system.

12. A motor according to claim 1, further comprising first and second modules positioned symmetrically and along the same axis in said housing, at a 90° angle, wherein each module comprises four of said pistons which are diametrically connected in pairs by two of said rods and which move in said annular space delimited by the housing and said rotary crown, so as to form the motor outlet shaft or be connected to it, said rotary crowns of the two modules being connected by said transmission mechanism to the shafts.

13. A motor according to claim 12, said transmission mechanism comprising first and second pinion gears, each having a drive shaft and which are common to both modules;

a crown gear provided in the housing which mesh with the first and second pinion gars;

a first and second crank pin wherein each of the pinion gears is driven on one side by said first crankpin, said crankpin being an integral part of the shaft connected to the rod of one pair of said pistons of each module and, on the other side by said second crankpin, said second crankpin being an integral part of the shaft connected to the rod of the other pair of said pistons of each module.

14. A motor according to claim 13, said first and second crankpins being connected to said drive shaft of each pinion gear at 90° angles.

* * * * *